US011420821B2

(12) United States Patent
McDade et al.

(10) Patent No.: US 11,420,821 B2
(45) Date of Patent: Aug. 23, 2022

(54) GARBAGE CAN RETENTION CLIP

(71) Applicant: Critter Clip LLC, Peoria, IL (US)

(72) Inventors: Theresa Lynn McDade, Peoria, IL (US); Matthew Joseph McDade, Peoria, IL (US)

(73) Assignee: Critter Clip LLC, Peoria, IL (US)

( * ) Notice: Subject to any disclaimer, the term of this patent is extended or adjusted under 35 U.S.C. 154(b) by 51 days.

(21) Appl. No.: 17/080,945

(22) Filed: Oct. 27, 2020

(65) Prior Publication Data

US 2022/0127076 A1 Apr. 28, 2022

(51) Int. Cl.
*B65F 1/16* (2006.01)

(52) U.S. Cl.
CPC ..... *B65F 1/1615* (2013.01)

(58) Field of Classification Search
CPC ..... B65F 1/1615; Y10S 220/908
USPC ..... 220/908
See application file for complete search history.

(56) References Cited

U.S. PATENT DOCUMENTS 3,363,924 A * 1/1968 Remig ..... B65F 1/1615 220/323
5,420,945 A * 5/1995 Concannon ..... G06K 7/015 358/475
5,772,264 A * 6/1998 Bettenhausen ..... B65F 1/1615 292/130
6,880,717 B1 * 4/2005 O'Conor ..... B65F 1/1615 292/288
2006/0169696 A1 * 8/2006 Taylor ..... B65D 55/16 220/730
2008/0169289 A1 * 7/2008 Dawn ..... B65F 1/1615 220/315
2014/0325805 A1 * 11/2014 Troiano ..... F16B 45/04 24/600.5
2021/0139236 A1 * 5/2021 Hanrahan ..... B65F 1/1615

* cited by examiner

*Primary Examiner* — Mollie Impink
(74) *Attorney, Agent, or Firm* — Adam K. Sacharoff; Much Shelist, P.C.

(57) ABSTRACT

The invention includes two interconnecting side release buckles configured to releasable connect to each other. A pair of webbing separately secured to one of the opposing ends of one of the side release buckles. Each of the webbing has a distal end with a stitched loop. A pair of D-rings secured within the stitched loops and secured to either the garbage can or lid by an attachment. Fasteners are secured through attachments and secured to the garbage can or lid, such that when the two interconnecting side release buckles are connected the hinged lid is prevented from opening away from the trash can.

2 Claims, 7 Drawing Sheets

GARBAGE CAN RETENTION CLIP

BACKGROUND OF THE INVENTION

The present invention relates to a garbage can retention clip for securing a hinged lid trash can against animal entry.

BRIEF SUMMARY OF THE INVENTION

The invention attaches to a hinged lid trash can. The invention holds the hinged lid trash can closed. The invention can be released by an individual for access and trash disposal while keeping the lid securely closed against animals.

Numerous other advantages and features of the invention will become readily apparent from the following detailed description of the invention and the embodiments thereof, from the claims, and from the accompanying drawings.

BRIEF DESCRIPTION OF THE DRAWINGS

A fuller understanding of the foregoing may be had by reference to the accompanying drawings, wherein.

DETAILED DESCRIPTION OF THE INVENTION

Figure 1:
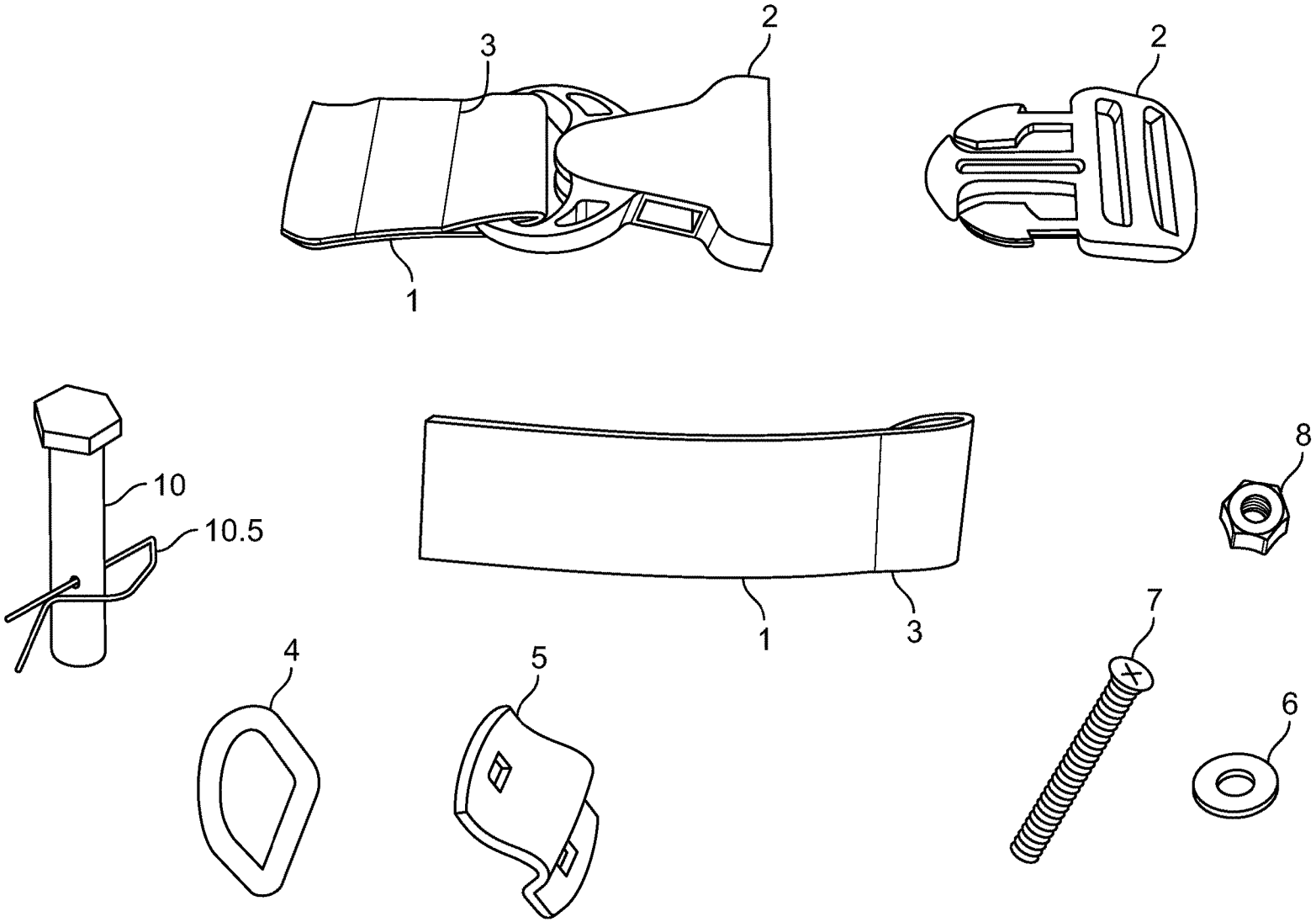
FIG. 1 out of 7 is a view of all the parts that make up the unbearable clip for Critter Can assembly or assembly on any hinged lid trash can.
Figure 2:
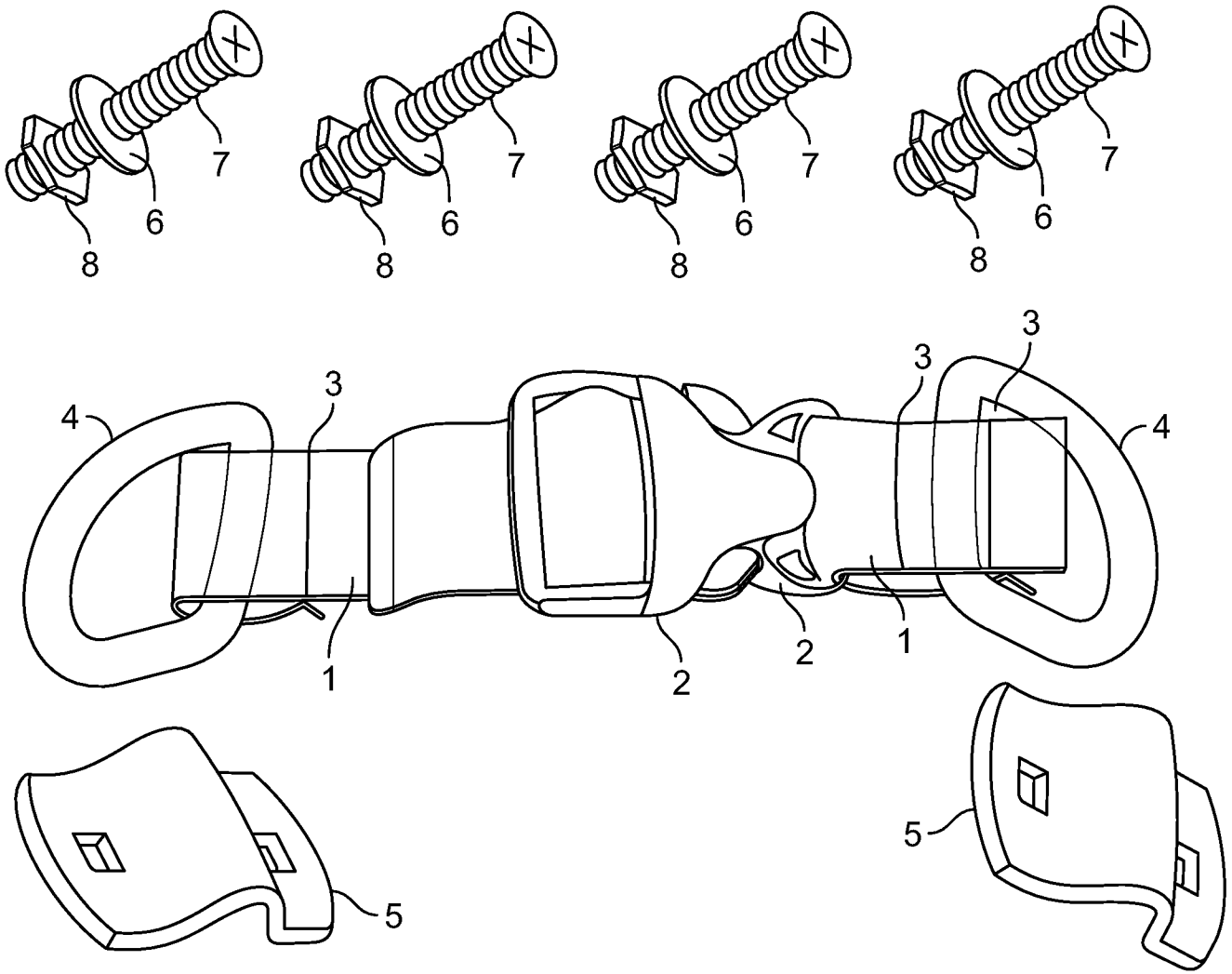
FIG. 2 out of 7 is a view of all the parts of the unbearable clip preassembly on any hinged lid trash can.
Figure 3:
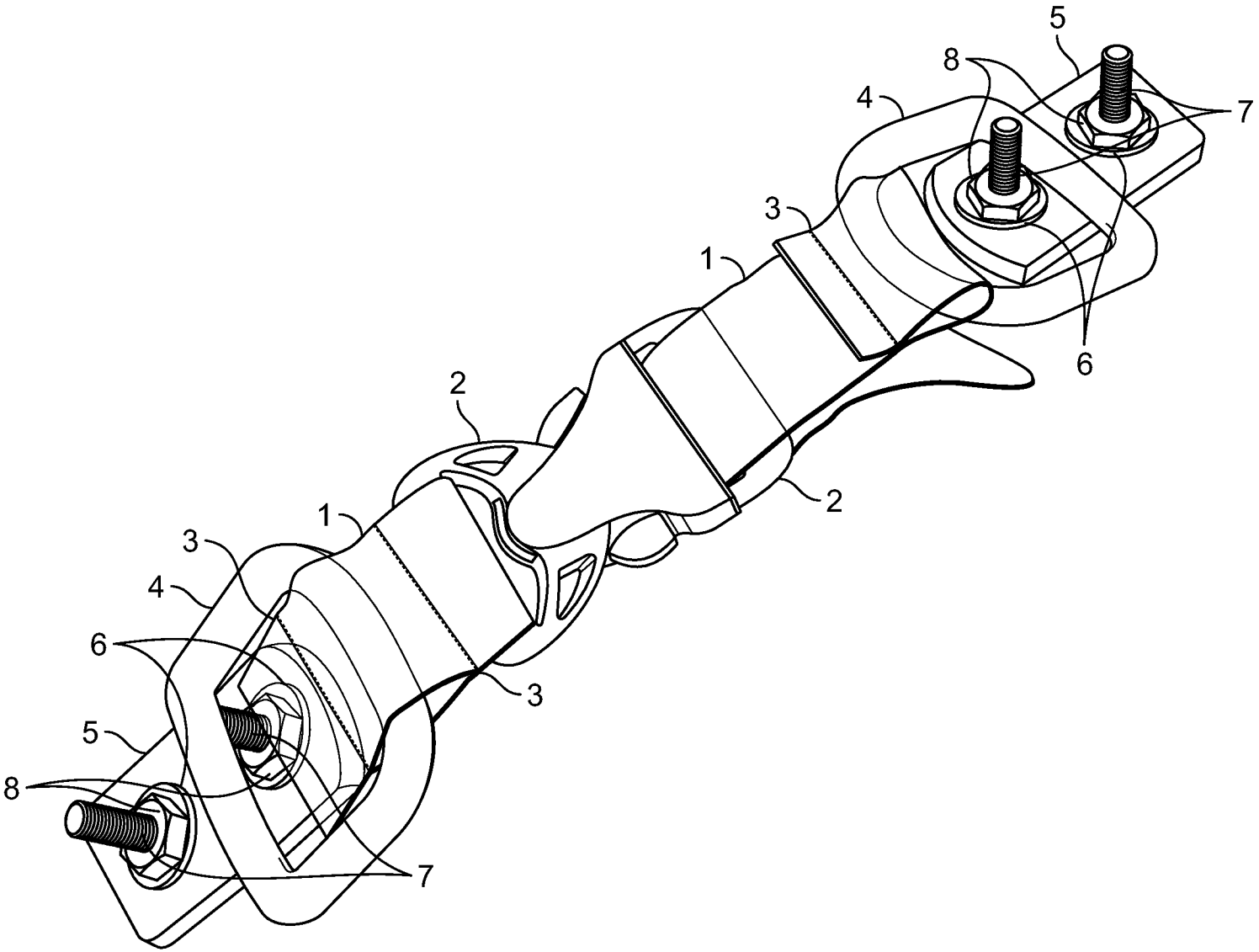
FIG. 3 out of 7 is a view of the underside of the assembled unbearable clip.
Figure 4:
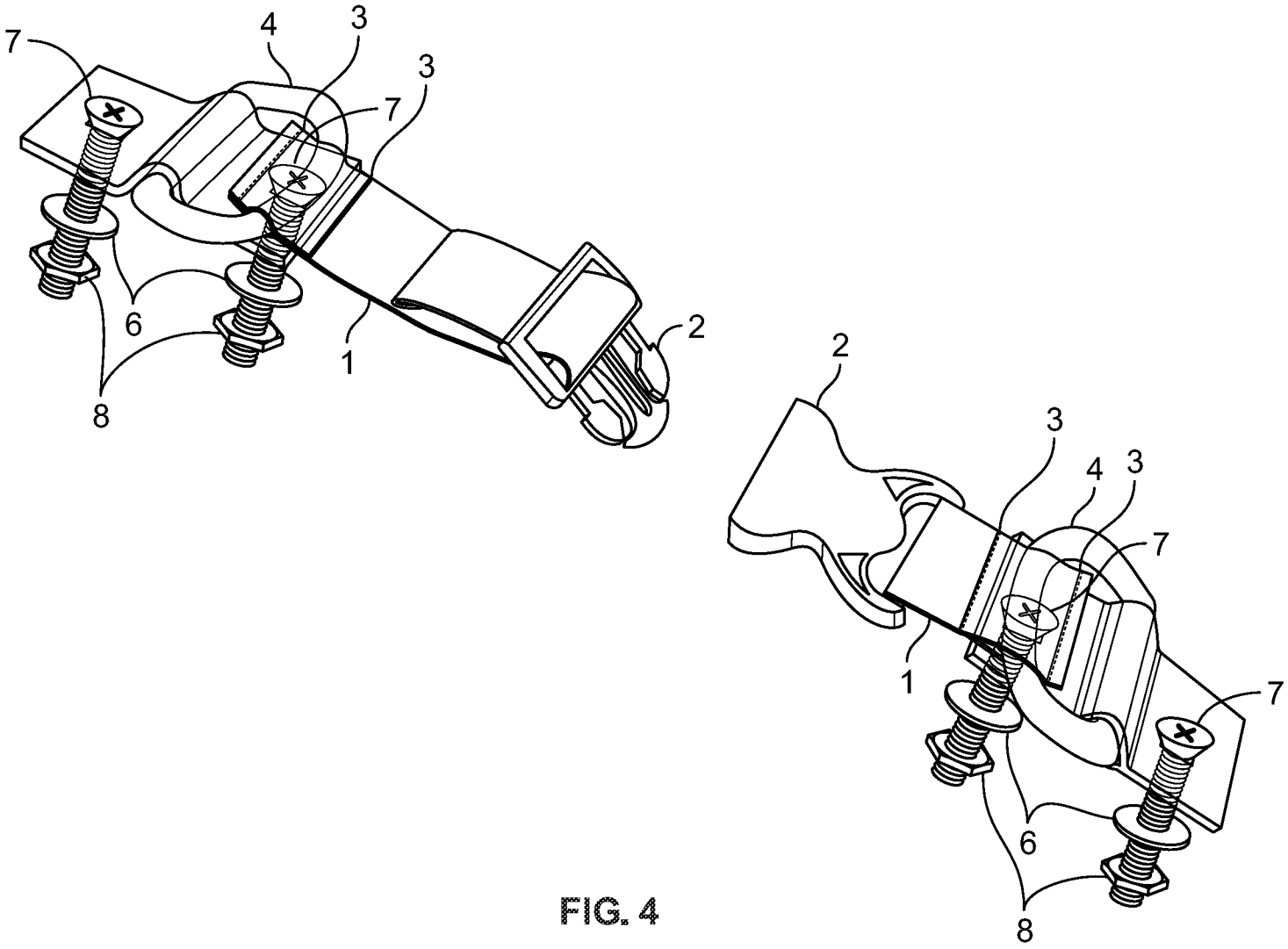
FIG. 4 out of 7 is a top view of the Unbearable Clip with all parts assembled. In this view, the side release buckle has been released.

While the invention is susceptible to embodiments in many different forms, there are shown in the drawings and will be described in detail herein the preferred embodiments of the present invention. It should be understood, however, that the present disclosure is to be considered an exemplification of the principles of the invention and is not intended to limit the spirit or scope of the invention and/or claims of the embodiments illustrated.

Referring now to FIGS. 1-7, the parts are defined as a 1" Cut resistant webbing 1, a 1" Metal side release buckle 2, a Stitched seam 3, a D-ring 4, a D-ring attachment 5, a Washer 6, Screw 7, Nut 8, Garbage Can 9, Stainless Steel Clevis pin 10, Hairpin 10.5, Clip set-backs on garbage can 11, and Clip hoods 12 on garbage can lid 12, and Garbage can lid 13.

As illustrated in FIGS. 1-5 the garbage can retention clip includes a two-piece metal side release buckle 2 that is configured to snap into each other as a male/female buckle connection. Secured and extending from either side of the buckle connection is a cut resistant webbing material 1 that includes an end secured around a D-ring 4. Each D-ring 4 is bolted or secured to the garbage can by a D-ring attachment 5. As illustrated, each D-ring attachment includes a ridged or channel to fit over a portion of the D-ring and openings on either ends of the D-ring attachment that are configured to receive bolts that are bolted into the trash can. When installed, the D-ring attachment secures the D-rings and thus each side of the side release buckle to one portion of the garbage can (one secures to the lid and one secures to the garbage can below the lid). The two buckle connection pieces are secured such that they are properly aligned and can attach into each other and thus maintain the garbage lid securely in place in a closed position against the garbage can.

Figure 5:
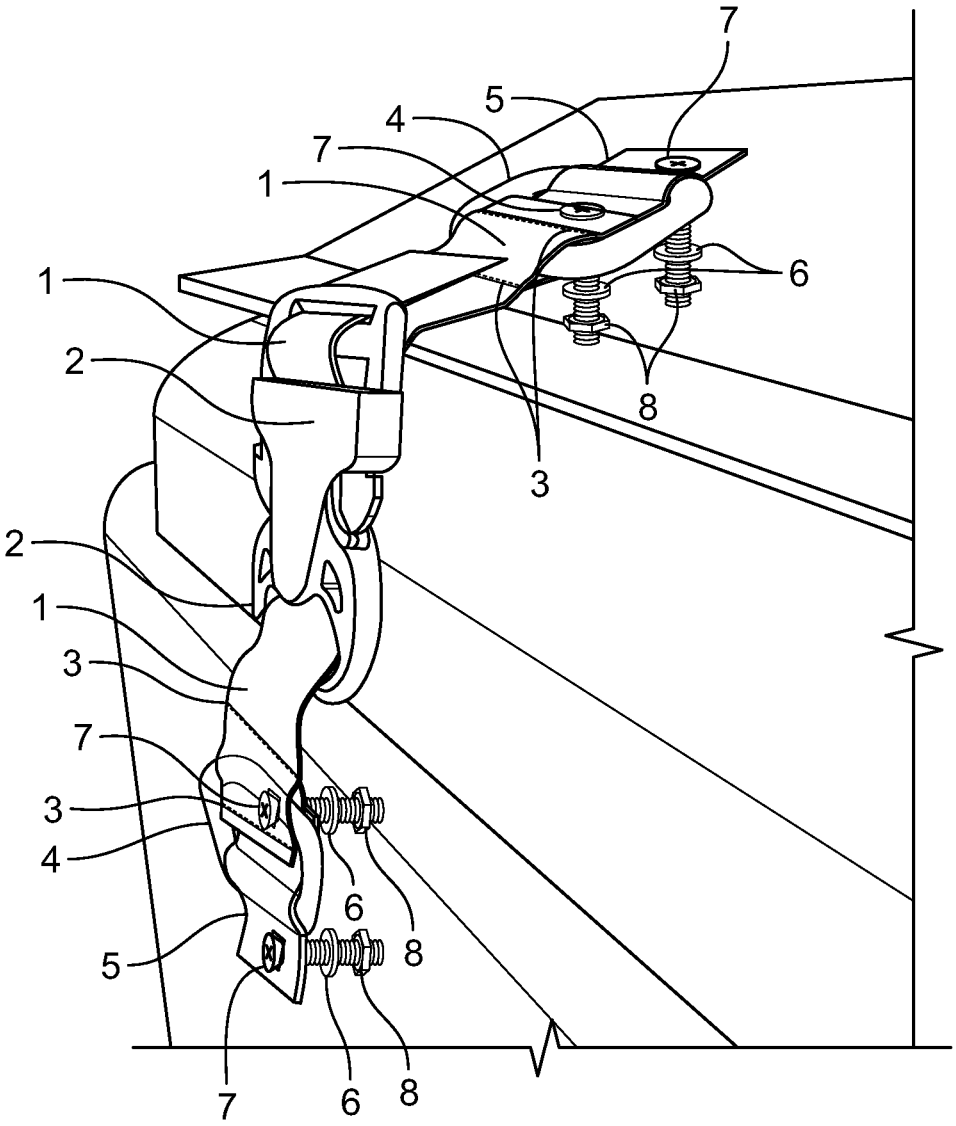
FIG. 5 out of 7 is a side view of the Unbearable Clip with all parts assembled and attached to a standard hinged lid trash can.

FIG. 5 is a side view of the Invention fully assembled and attached to a hinged lid trash can. The female side of the side release buckle 2 is attached to the trash can, while the male side of the side release buckle 2 is attached to the hinged lid. However, this can easily be reversed. The metal bolts 7 are shown securing the D-ring attachment 5 to a portion of the garbage can or lid, which secures the D-ring in place. The bolts can also include a metal washer 6 and metal nut 8. By placing the male side of the side release buckle into the female side of the side release buckle and tightening the adjustable polyester webbing on the male side of the side release buckle the Invention will now hold the hinged lid securely shut against animal entry.

Figure 6:
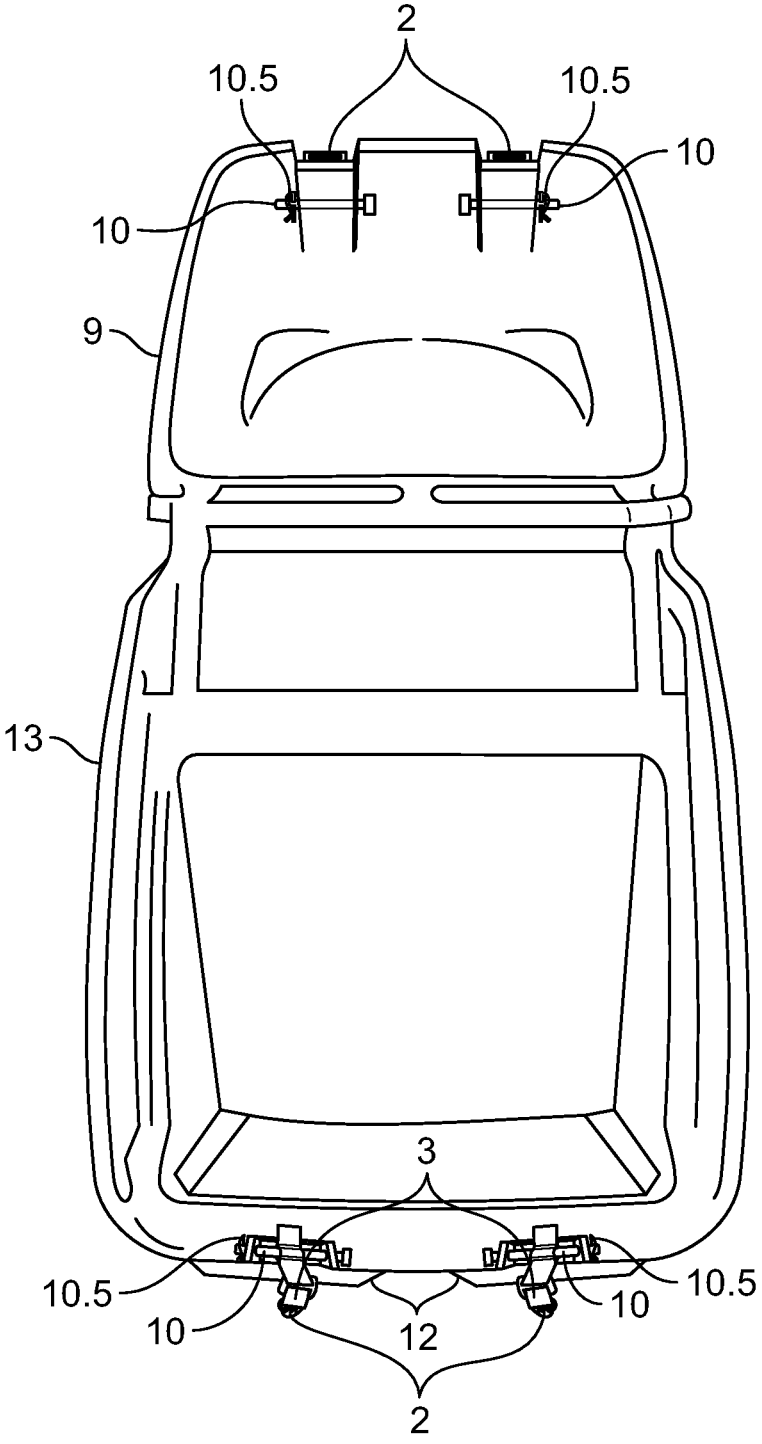
FIG. 6 out of 7 is an interior view of the can and lid with the Unbearable Clip as attached to the Critter Can.
Figure 7:
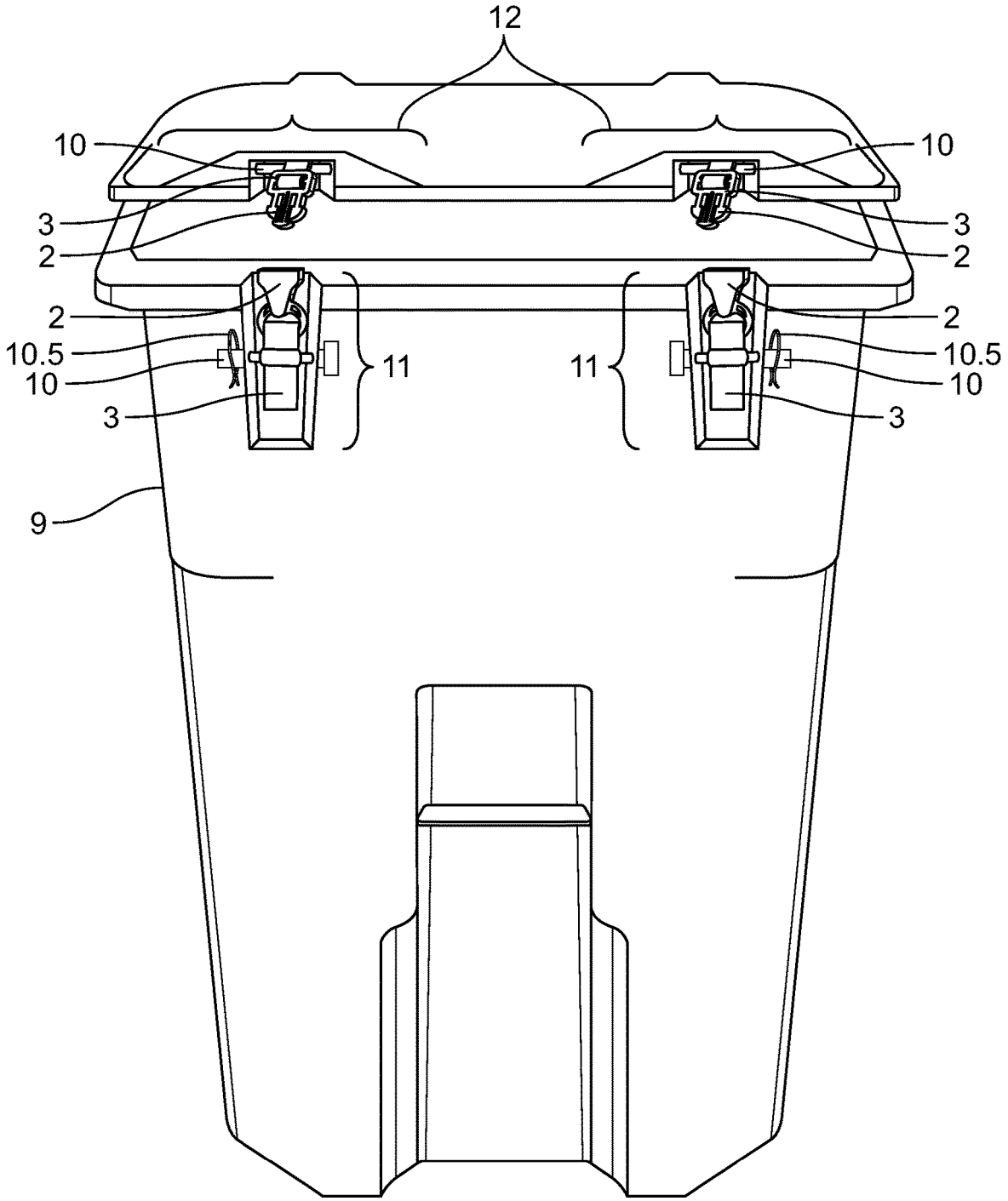
FIG. 7 out of 7 is the front, exterior view of the Unbearable Clip attached to the Critter Can.

In another aspect of the invention, the garbage can is specifically design and created for the retention clips. Referring now to FIGS. 6 and 7, the garbage can 9 and lid 13 have sectioned molded into both to better receive the respective halves of the retention clips. For example, the garbage can 9 includes a pair of slotted can channels 20 adjacent the top edge of the garbage can and that are aligned vertically down the side of the garbage can. Each slotted can channel 20 includes aligned openings to receive the Steel Clevis pin 10 on the inside of the garbage can (with the center of the Steel Clevis pin 10 being on the outside of the garbage can through the slotted can channel 20) and which is locked in place by Hairpin 10.5. The steel clevis pin 10 fits through a loop in the webbing 1 created by stitching 3 on one end of the two-piece buckle connection. Similarly, corresponding lid channels 30 are provided in the lid 13, also with a steel clevis pin 10 fitted through another loop on the corresponding other end of the two-piece buckle connection. The two-piece buckle connection is aligned for connection with the lid is closed against the garbage can. In addition, the lid may include clip hoods 13 covering each of the lid channels 30.

With the garbage can and lid specifically designed for the retaining clips, the D-ring and D-ring attachments are not needed.

As provided by the description and the figures, in a first embodiment there is provided a device for securing a hinged lid to a trash can preventing animals from gaining entry therein. The device includes: (a) two interconnecting side release buckles having first ends configured to releasable connect to each other and having second opposing ends; (b) a first webbing being adjustably secured to one of the opposing ends of one of the side release buckles, the first webbing further having a first webbing distal end with a first stitched loop; (c) a second webbing secured to the other opposing end of the other side release buckle, the second webbing further having a second webbing distal end with a second stitched loop; (d) a pair of D-rings, separately secured within the first stitched loop and the second stitched loop; (e) a pair of D-ring attachments, each D-ring attachments having a mid-section bowed outwardly to secure around a portion of a D-ring and further having ends extending on either side of the mid-section, each end having with an opening, wherein one of the D-ring attachments being positioned over a D-ring and against a portion of the trash can, and wherein the other D-ring attachment being positioned over the other D-ring and against a portion of the hinged lid; and (f) fasteners secured through the openings on the mid-section of each of the pair of D-ring attachments and positioned through the trash can and hinged lid, such that when the two interconnecting side release buckles are connected the hinged lid is prevented from opening away from the trash can.

In a second embodiment, there is provided a garbage can and a lid in further combination with a releasable mechanism to prevent animal entry into the garbage can. The combination is configured to provide: (a) a garbage can having a top edge surrounding an opening into the garbage can, and further having a pair of indented slotted channels adjacent the top edge and positioned a predetermined distance apart from each other horizontally along a portion of the outside of the garbage can, and wherein the indented slotted channels are indented in relation to an inside of the garbage can, each slotted channel having at least one pair of aligned slotted channel apertures; (b) a lid hinged to a portion of the top edge of the garbage can and along a portion opposite the pair of indented slotted channels, the lid further having a pair of lid channels corresponding in a single alignment position with the pair of indented slotted channels, each of the lid channels having channel ends with a pair of aligned lid channel apertures; (c) two interconnecting side release buckles having first ends configured to releasable connect to each other and having second opposing ends; (d) a first webbing being secured to one of the opposing ends of one of the side release buckles, the first webbing further having a first webbing distal end with a first stitched loop; (e) a second webbing secured to the other opposing end of the other side release buckle, the second webbing further having a second webbing distal end with a second stitched loop; (f) two pair of steel clevis pins, each pair being configured for insertion through the first stitched loop or the second stitched loop and separately being received either through the pair of aligned lid channel apertures or through the pair of aligned lid channel apertures; and (g) each steel clevis pin being locked in place by a hairpin being inserted through a pin opening in each steel clevis pin, such that when the hinged lid is closed against the garbage can top edge, two interconnecting side release buckles are aligned to be connected such that the hinged lid is prevented from opening away from the trash can.

In another aspect of the second embodiment the garbage can and a lid combination may further include clip hoods positioned along the lid over the lid channels.

From the foregoing and as mentioned above, it is observed that numerous variations and modifications may be effected without departing from the spirit and scope of the novel concept of the invention. It is to be understood that no limitation with respect to the embodiments illustrated herein is intended or should be inferred. It is intended to cover, by the appended claims, all such modifications within the scope of the appended claims.

We claim:

1. The garbage can having a lid in further combination with a releasable mechanism to prevent animal entry into the garbage can, comprising:

a garbage can having a top edge surrounding an opening into the garbage can, and further having a pair of indented slotted channels adjacent the top edge and positioned a predetermined distance apart from each other horizontally along a portion of the outside of the garbage can, and wherein the indented slotted channels are indented in relation to an inside of the garbage can, each slotted channel having at least one pair of aligned slotted channel apertures;

the lid hinged to a portion of the top edge of the garbage can and along a portion opposite the pair of indented slotted channels, the lid further having a pair of lid channels corresponding in a single alignment position with the pair of indented slotted channels, each of the lid channels having channel ends with a pair of aligned lid channel apertures;

two interconnecting side release buckles having first ends configured to releasable connect to each other and having second opposing ends;

a first webbing being secured to one of the opposing ends of one of the side release buckles, the first webbing further having a first webbing distal end with a first stitched loop;

a second webbing secured to the other opposing end of the other side release buckle, the second webbing further having a second webbing distal end with a second stitched loop;

two pair of steel clevis pins, each pair being configured for insertion through the first stitched loop or the second stitched loop and separately being received either through the pair of aligned lid channel apertures or through the pair of aligned lid channel apertures; and each steel clevis pin being locked in place by a hairpin being inserted through a pin opening in each steel clevis pin, such that when the hinged lid is closed against the garbage can top edge, two interconnecting side release buckles are aligned to be connected such that the hinged lid is prevented from opening away from the trash can.

2. The garbage can and a lid combination with a releasable mechanism to prevent animal entry into the garbage can of claim 1, further comprising: clip hoods positioned along the lid over the lid channels.

* * * * *